US007228908B2

(12) United States Patent
East, Jr. et al.

(10) Patent No.: US 7,228,908 B2
(45) Date of Patent: Jun. 12, 2007

(54) HYDROCARBON SWEEP INTO HORIZONTAL TRANSVERSE FRACTURED WELLS

(75) Inventors: Loyd E. East, Jr., Tomball, TX (US); Leldon M. Farabee, Houston, TX (US); John M. Warren, Jr., Cypress, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 361 days.

(21) Appl. No.: 11/003,804

(22) Filed: Dec. 2, 2004

(65) Prior Publication Data

US 2006/0118305 A1 Jun. 8, 2006

(51) Int. Cl.
*E21B 43/26* (2006.01)

(52) U.S. Cl. ..... 166/308.2; 166/272.2; 166/272.7; 166/271

(58) Field of Classification Search ..... 166/272.2, 166/272.7, 271
See application file for complete search history.

(56) References Cited

U.S. PATENT DOCUMENTS

| | | | | |
|---|---|---|---|---|
| 3,878,884 | A | 4/1975 | Raleigh | |
| 4,390,067 | A * | 6/1983 | Willman | 166/245 |
| 4,476,932 | A | 10/1984 | Emery | |
| 5,025,859 | A * | 6/1991 | Hanson et al. | 166/252.1 |
| 5,074,360 | A | 12/1991 | Guinn et al. | |
| 5,183,109 | A | 2/1993 | Poulsen | |
| 5,249,628 | A | 10/1993 | Surjaatmadja | |
| 5,325,923 | A | 7/1994 | Surjaatmadja et al. | |
| 5,396,957 | A | 3/1995 | Surjaatmadja et al. | |
| 5,499,678 | A | 3/1996 | Surjaatmadja et al. | |
| 5,533,571 | A | 7/1996 | Surjaatmadja et al. | |
| 5,765,642 | A | 6/1998 | Surjaatmadja | |
| 6,047,773 | A | 4/2000 | Zeltmann et al. | |
| 6,095,244 | A | 8/2000 | Graham et al. | |
| 6,119,776 | A | 9/2000 | Graham et al. | |
| 6,167,966 | B1 | 1/2001 | Ayasse et al. | |
| 6,328,104 | B1 * | 12/2001 | Graue | 166/259 |
| 6,364,015 | B1 | 4/2002 | Upchurch | |
| 6,585,040 | B2 | 7/2003 | Hanton et al. | |
| 6,662,874 | B2 | 12/2003 | Surjaatmadja et al. | |
| 6,814,141 | B2 * | 11/2004 | Huh et al. | 166/249 |
| 2003/0234106 | A1 | 12/2003 | Surjaatmadja | |

OTHER PUBLICATIONS

T.J. Love, et al., "Selectively Placing Many Fractures in Openhole Horizontal Wells Improves Production," SPE Paper 50422, 1998.
Halliburton Technical Brochure entitled "Cobra Frac$^{SM}$ Service", 2000.

(Continued)

*Primary Examiner*—Frank Tsay
(74) *Attorney, Agent, or Firm*—John W. Wustenberg; Baker Botts, L.L.P.

(57) ABSTRACT

The present invention is directed to a method of increasing hydrocarbon production in an existing well in a hydrocarbon reservoir. The method includes the steps of forming a substantially horizontal transverse fractured wellbore that intersects the existing well and injecting a fluid remote from the existing well so as to form a fluid front that sweeps the hydrocarbons into the horizontal transverse fractured wellbore. Successive fractures can be sealed to control propagation of the fluid front and delay infiltration of the fluid into the production.

27 Claims, 10 Drawing Sheets

OTHER PUBLICATIONS

Halliburton Technical Brochure entitled "Surgifrac$^{SM}$ Service", 2002.

B.W. McDaniel, et al., "Evolving New Stimulation Process Proves Highly Effective in Level 1 Dual-Lateral Completion," SPE Paper 78697, Oct. 23, 2002.

Halliburton Technical Brochure entitled "Cobra Jet Frac$^{SM}$ Service", undated.

Alex Turta, et al.; *Toe-To-Heel Waterflooding. Part II: 3D Laboratory Test Results*; SPE Annual Technical Conference and Exhibition; Denver, Colorado (Oct. 5-8, 2003); SPE 84077, Oct. 5, 2003.

Gutierrez, O.D. Alter, et al.; *Using Multilateral Well Technology To Improve Recovery Factor By Water Flooding in a Giant Mature Oil Field in Venezuela Lagunilla Inferior* (*LL-03*); 2002 SPE International Thermal Operations and Heavy Oil Symposium and International Horizontal Well Technology Conference; Calgary, Alberta, Canada (Nov. 4-7, 2002); SPE/Petroleum Society of CIM/CHOA 78955, Nov. 4, 2002.

A. Bryce Cunningham, et al.; *Field Testing and Study of Horizontal Water Injectors in Increasing Ultimate Recovery From a Reservoir in Thamama Formation in a Peripheral Water Injection Scheme in a Giant Carbonate Reservoir, United Arab Emirates*; Abu Dhabi International Petroleum Exhibition & Conference (Oct. 13-16, 2002); SPE 78480, Oct. 13, 2002.

B.W. McDaniel, et al.; *Overview of Stimulation Technology for Horizontal Completions Without Cemented Casing in the Lateral*; SPE Asia Pacific Oil and Gas Conference and Exhibition; Melbourne, Australia (Oct. 8-10, 2002); SPE 77825, Oct. 8, 2002.

W.A. Minner et al.; *Waterflood and Production-Induced Stress Changes Dramatically Affect Hydraulic Fracture Behavior in Lost Hills Infill Wells*; SPE Annual Technical Conference and Exhibition; San Antonio, Texas (Sep. 29-Oct. 2, 2002); SPE 77536, Sep. 29, 2002.

P.L. McGuire, et al.; *Unconventional Miscible EOR Experience at Prudhoe Bay; A Project Summary*; Revised for Publication From SPE 72107, First Presented at the 2001 SPE Asia Pacific Improved Oil Recovery Conference; Kuala Lumpur (Oct. 8-9, 2001); SPE 82140, Oct. 8, 2001.

Y. Bigno et al.; *Multilateral Waterflood Development of a Low-Permeability Carbonate Reservoir*; 2001 SPE Annual Technical Conference and Exhibition; New Orleans, Louisiana (Sep. 30-Oct. 3, 2001); SPE 71609, Sep. 30, 2001.

K.A. Edwards, et al.; *Horizontal Injectors Rejuvenate Mature Miscible Flood—South Swan Hills Field*; Revised for Publication From SPE 70066, First Presented at the 2001 SPE Permian Basin Oil and Gas Recovery Conference; Midland, Texas (May 15-16, 2001); SPE 77302, May 15, 2001.

B.W. McDaniel, et al.; *Limited-Entry Frac Applications on Long Intervals of Highly Deviated or Horizontal Wells*; 1999 SPE Annual Technical Conference and Exhibition; Houston, Texas (Oct. 3-6, 1999); SPE 56780, Oct. 3, 1999.

J.B. Surjaatmadja, et al.; *Hydrajet Fracturing: An Effective Method for Placing Many Fractures in Openhole Horizontal Wells*; 1998 SPE International Conference and Exhibition in China; Beijing, China (Nov. 2-6, 1998): SPE 48856, Nov. 2, 1998.

M.R. Norris, et al.; *Multiple Proppant Fracturing of Horizontal Wellbores in a Chalk Formation: Evolving the Process in the Valhall Field*; 1998 SPE European Petroleum Conference; The Hague, The Netherlands (Oct. 20-22, 1998); SPE 50608, Oct. 20, 1998.

C.E. Austin, et al.; *Simultaneous Multiple Entry Hydraulic Fracture Treatments of Horizontally Drilled Wells*; 63rd Annual Technical Conference and Exhibition of the Society of Petroleum Engineers; Houston, Texas (Oct. 2-5, 1988); SPE 18263, Oct. 2, 1988.

M.A. Emanuele, et al.; *A Case History: Completion and Stimulation of Horizontal Wells With Multiple Transverse Hydraulic Fractures in the Lost Hills Diatomite*; 1998 SPE Western Regional Meeting; Bakersfield, California (May 10-13, 1998); SPE 46193, May 10, 1998.

Foreign communication from related counter part application dated Dec. 2, 2005.

* cited by examiner

HYDROCARBON SWEEP INTO HORIZONTAL TRANSVERSE FRACTURED WELLS

BACKGROUND

The present invention relates generally to hydrocarbon production, and more particularly to a method of increasing hydrocarbon production in an existing well by forming a substantially horizontal transverse fractured wellbore, which intersects the existing well and injecting a fluid into the reservoir to sweep the hydrocarbons into the substantially horizontal transverse fractured wellbore.

In certain subterranean formations, fluid is injected into the reservoir to displace or sweep the hydrocarbons out of the reservoir. This method of stimulating production is sometimes referred to as a method of "Enhanced Oil Recovery" and may be called waterflooding, gasflooding, steam injection, etc. For the purpose of this specification, the general process will be defined as injecting a fluid (gas or liquid) into a reservoir in order to displace the existing hydrocarbons into a producing well. The primary issue with injecting fluid to enhance oil recovery is how to sweep the reservoir of the hydrocarbon in the most efficient manner possible. Because of geological differences in a reservoir, the permeability may not be homogenous. Because of such permeability differences between the vertical and horizontal directions or the existence of higher permeability streaks, the injecting fluid may bypass some of the reservoir and create a path into the producing well.

The industry has come up with numerous methods to improve the sweep efficiency and the overall reservoir that is swept by individual wells. These methods include fracturing and the use of horizontal wells. The industry currently uses horizontal wells as injectors in an attempt to expose more of the reservoir to the injecting fluid. The goal is to create a movement of injection fluid evenly across the reservoir. This is sometimes referred to as line drive. The industry also uses horizontal wells as producers, again the goal being to evenly produce the reservoir so to form a line drive.

SPE Paper 84077 presents a method referred to as toe-to-heel waterflooding where a horizontal lateral is used to produce the reservoir with a vertical injector located nearer the toe (end) of the lateral. The method referred to in this paper is limited, since the horizontal lateral only covers a limited area in the reservoir. It therefore does not maximize the amount of surface area that can be used to recover the hydrocarbons. This method also suffers from an inability to control the influx of injection fluid at the toe to improve recovery.

Part of the efficiency of the sweep is reducing the production of the injection fluid. The industry has created several techniques from the use of chemicals that block the injection fluid, to injection fluids that improve the matrix flow through the reservoir to reduce channeling. Some injection programs include attempts to plug high permeability streaks and natural fractures in the reservoir. This is done to force the injection fluid out into more of the reservoir to displace hydrocarbons.

When the injection fluid is produced, such as water, it is usually removed from the hydrocarbons at the surface using multi-phase separation devices. These devices operate to agglomerate and coalesce the hydrocarbons, thereby separating them from the water. A drawback of this approach, however, is that no separation process is perfect. As such, some amount of the hydrocarbons always remains in the water. This can create environmental problems when disposing of the water, especially in off-shore applications. Also, the multi-phase separation devices are rather large in size, which is another disadvantage in off-shore applications, as space is limited. Yet another drawback is that these devices can require additional maintenance or repair if solids are part of the produced fluid stream. A further, and perhaps greatest drawback of these solutions, is that they do nothing to increase or maximize the amount of hydrocarbons being produced. Their only focus is removing the water from the production.

Specialized downhole tools have also been developed, which separate the water from the hydrocarbons downhole. These tools are designed to leave the water in the formation as the hydrocarbons are produced. While these devices can remove a significant amount of water from the hydrocarbons, they are also often less than perfect in removing the water from the hydrocarbons. They also suffer from the same drawback of the surface separation devices in that they do nothing to increase or maximize the amount of hydrocarbons being produced.

A solution is therefore desired that not only improves the efficiency and economics of enhanced oil recovery through injection, but that also reduces the amount of injection fluid that infiltrates the hydrocarbon production of an existing well.

SUMMARY

The present invention is directed to a method of increasing hydrocarbon production in an existing well in a hydrocarbon reservoir, which minimizes the drawbacks of prior art methods and apparatuses. In one embodiment, the method includes the steps of forming a substantially horizontal transverse fractured wellbore; and injecting a fluid in the reservoir so as to form a fluid front that sweeps the hydrocarbons into the horizontal transverse fractured wellbore.

In another embodiment, the method according to the present invention includes the steps of drilling a substantially horizontal wellbore that intersects the existing well and forming at least one transverse fracture in the reservoir along the substantially horizontal wellbore. In one exemplary embodiment, a plurality of transverse fractures are formed. The method further includes the steps of drilling an injection well into the reservoir and injecting a fluid into the reservoir through the injection well so as to sweep the hydrocarbons toward the plurality of transverse fractures. The hydrocarbons can then be drained into the plurality of transverse fractures.

In another embodiment, the method according to the present invention includes the steps of drilling a substantially horizontal wellbore that intersects the existing well, forming a plurality of transverse fractures in the reservoir along the substantially horizontal wellbore, and installing a tubing in the substantially horizontal wellbore with an end of the tubing being disposed at a toe portion of the substantially horizontal wellbore, downhole of the farthest transverse fracture. The terms "downhole" and "uphole" are defined herein to describe locations away from and toward, respectively, the existing well. In other words, one object which is downhole of another is farther away from the existing well than the other object and one object which is uphole of another is closer to the existing well than the other object. This embodiment further includes the steps of installing a packer between the tubing and a sidewall forming the substantially horizontal wellbore uphole of the farthest transverse fracture, injecting a fluid into the reservoir through the end of the tubing at the toe of the substantially horizontal wellbore to sweep the hydrocarbons toward the plurality of transverse fractures, and draining the hydrocarbons into the plurality of transverse fractures. No separate injection well is drilled with this embodiment.

In yet another embodiment, the method according to the present invention includes the steps of drilling a first substantially horizontal wellbore that intersects the existing well and forming a plurality of transverse fractures in the reservoir along the first substantially horizontal wellbore. This method also includes the steps of drilling a second substantially horizontal wellbore that intersects the existing well, and forming at least one transverse fracture in the reservoir along the second substantially horizontal wellbore. This method further includes the steps of sealing the at least one transverse fracture formed along the second substantially horizontal wellbore and draining the hydrocarbons into the plurality of transverse fractures formed along the first substantially horizontal wellbore.

In yet another embodiment, the method according to the present invention includes the steps of drilling a pair of oppositely disposed substantially horizontal injection wellbores that intersect the existing well, drilling a plurality of substantially horizontal producing wellbores that intersect the existing well and are disposed between the injection wellbores and forming a plurality of transverse fractures in the reservoir along each of the plurality of substantially horizontal producing wellbores. The method further includes the step of injecting a fluid into the reservoir from the pair of oppositely disposed substantially horizontal injection wellbores and draining the hydrocarbons into the plurality of transverse fractures formed along the plurality of substantially horizontal producing wellbores.

In still another embodiment, the method according to the present invention includes the steps of drilling a pair of oppositely disposed substantially horizontal injection wellbores that intersect the existing well, drilling a pair of oppositely disposed substantially horizontal producing wellbores that intersect the existing well and are disposed between the injection wellbores, each producing wellbore being formed with a plurality of laterals, and forming a plurality of transverse fractures in the reservoir along each of the plurality of laterals. This method further includes the steps of injecting a fluid into the reservoir from the pair of oppositely disposed substantially horizontal injection wellbores and draining the hydrocarbons into the plurality of transverse fractures formed along the plurality of laterals.

In another embodiment, the transverse fractures along the wellbore are created in stages during the production of the well rather than at the outset. For example, a transverse fracture at the toe is created and produced, then another transverse fracture is created uphole and injection fluid is pumped into the end fracture to sweep the formation between the two fractures. After a period of time either scheduled or determined by performance of the well more transverse fractures can be added along the wellbore to sweep more of the formation intersected by the lateral.

As part of these embodiments using transverse fractures, the flow from the transverse fractures is controlled by injecting chemicals into the transverse fractures to seal or partially seal the fracture in order to reduce the movement of the injection fluid into the fracture and force the injection fluid out into the reservoir away from the wellbore so as to increase the sweep area.

The features and advantages of the present invention will be readily apparent to those skilled in the art upon a reading of the description of the exemplary embodiments, which follows.

BRIEF DESCRIPTION OF THE DRAWINGS

A more complete understanding of the present disclosure and advantages thereof may be acquired by referring to the following description taken in conjunction with the accompanying drawings, which.

DETAILED DESCRIPTION

The details of the present invention will now be described. The present invention is directed to a method of increasing hydrocarbon recovery from an existing well through injecting fluid to displace the hydrocarbons from the reservoir while simultaneously reducing the influx of water and other non-hydrocarbon fluids, such as carbon dioxide, into the existing well. In its most basic form, the present invention achieves its goal by providing at least one substantially horizontal wellbore having a plurality of transverse fractures, sealing at least one of the transverse fractures and injecting a flood fluid, such as water, into the formation so as to force the hydrocarbons into the remaining transverse fractures. As those of ordinary skill in the art will appreciate from the disclosure that follows, there are many different ways of arranging the substantially horizontal wells, many different ways of injecting the fluid into the formation, and many different ways of recovering the hydrocarbons into the transverse fractures. A number of exemplary ways of performing these functions are disclosed herein.

Figure 1:
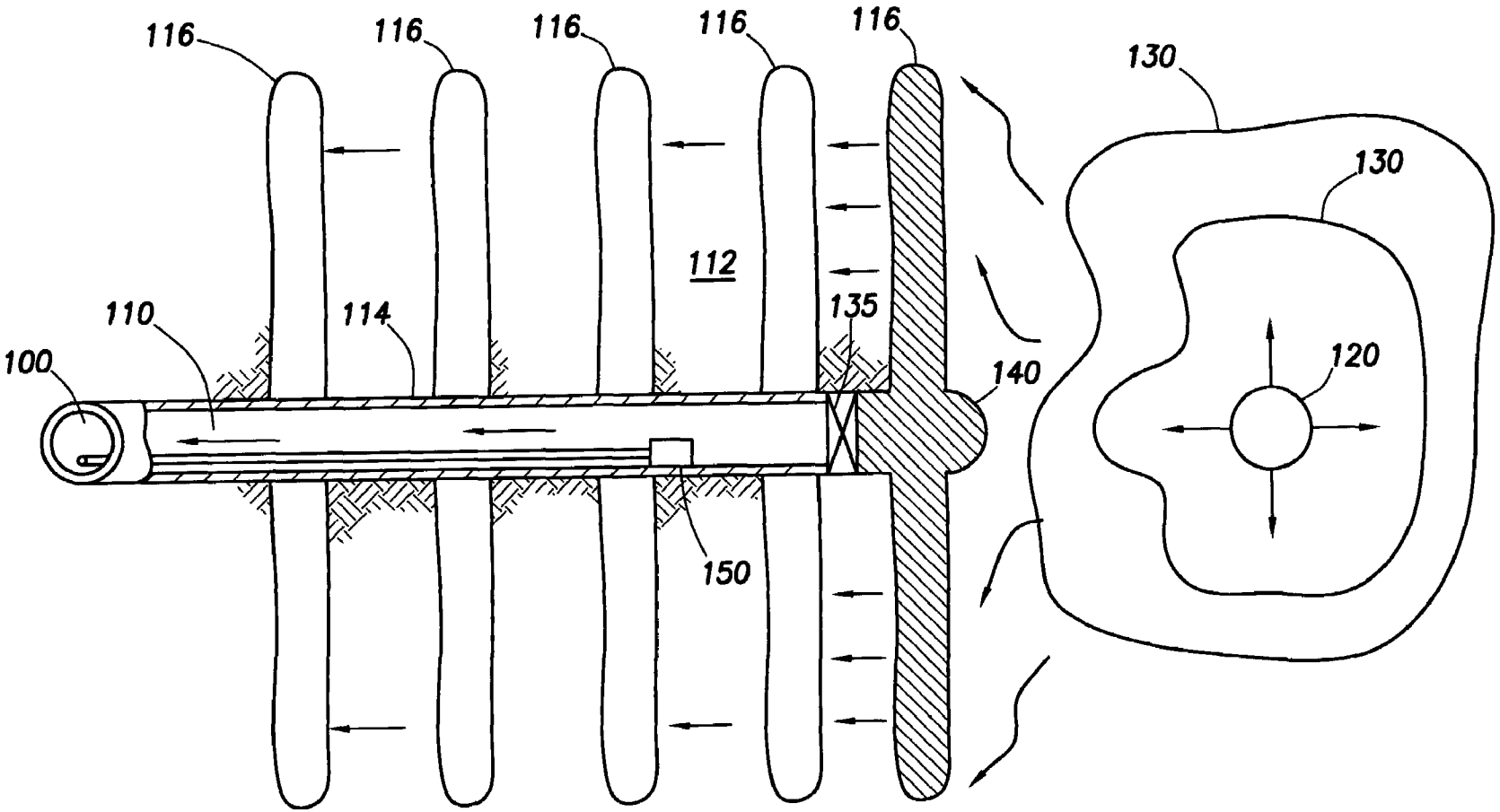
FIG. 1 is a schematic diagram illustrating one embodiment of the present invention wherein one transverse fracture in the substantially horizontal wellbore is at least partially sealed and fluid injected from a separate injection well sweeps the hydrocarbons into the remaining transverse fractures.

Turning to FIG. 1, a well configuration formed using one exemplary method according to the present invention is illustrated. In this embodiment, a substantially horizontal wellbore 110 is drilled into hydrocarbon reservoir 112 from existing well 100. Substantially horizontal wellbore 110 can be drilled using conventional directional drilling techniques or other similar methods. The precise method used is not critical to the present invention. In one certain exemplary embodiment, the wellbore 110 is lined with a casing string 114. The casing string 114 may then be cemented to the formation. There are a number of factors that go into the decision of whether or not to case the wellbore 110 and whether or not to cement the casing 114 to the formation. A person of ordinary skill in the art should know whether the wellbore 110 needs to be cased. In most cases, it will be beneficial to do so.

Next, a plurality of transverse fractures 116 are formed along the horizontal wellbore 110. The transverse fractures 116 are formed along the natural fracture line and generally parallel to one another. There are a number of different ways of carrying out this step. In one exemplary embodiment, the plurality of transverse fractures 116 are formed by using a hydra jetting tool, such as that used in the SurgiFrac® fracturing service offered by Halliburton Energy Services. In this embodiment, the hydra jetting tool forms each fracture of the plurality of transverse fractures 116 one at a time. Each transverse fracture 116 is formed by the following steps: (i) positioning the hydra jetting tool in the substantially horizontal wellbore 110 at the location where the transverse fracture 116 is to be formed, (ii) perforating the reservoir 112 at the location where the transverse fracture 116 is to be formed, and (iii) injecting a fracture fluid into the perforation at sufficient pressure to form a transverse fracture 116 along the perforation. As those of ordinary skill in the art will appreciate, there are many variations on this embodiment. For example, fracture fluid can be simultaneously pumped down the annulus while it is being pumped out of the hydra jetting tool to initiate the fracture or not. Alternatively, the fracturing fluid may be pumped down the annulus and not through the hydra jetting tool to initiate and propagate the fracture, i.e., in this version the hydra jetting tool only forms the perforations.

In another version of this embodiment, the plurality of transverse fractures 116 are formed by staged fracturing. Staged fracturing is performed by (i) detonating a charge in the substantially horizontal wellbore 110 at the location where a transverse fracture 116 is to be formed so as to form a perforation in the reservoir at that location, (ii) pumping a fracture fluid into the perforation at sufficient pressure to propagate the transverse fracture 116, (iii) installing a plug in the substantially horizontal well 110 bore uphole of the transverse fracture 116, (iv) repeating steps (i) through (iii) until the desired number of transverse fractures 116 have been formed; and (v) removing the plugs following the completion of step (iv). As those of ordinary skill in the art will appreciate, there are many variants on the staged fracture method.

In yet another version of this embodiment, the plurality of transverse fractures 116 are formed using a limited entry perforation and fracture technique. The limited entry perforation and fracture technique is performed by (i) lining the substantially horizontal wellbore 110 with a casing string 114 having a plurality of sets of predrilled holes arranged along its length, and (ii) pumping a fracturing fluid through the plurality of sets of predrilled holes in the casing string at sufficient pressure to fracture the reservoir 112 at the locations of the sets of predrilled holes.

In still another version of this embodiment, the plurality of transverse fractures 116 are formed by the steps of (i) installing a tool having a plurality of hydra jets formed along its length into the substantially horizontal wellbore 110, and (ii) pumping fluid through the plurality of hydra jets simultaneously at one or more pressures sufficient to first perforate and then fracture the reservoir 112 at the locations of the hydra jets.

After the substantially horizontal wellbore 110 has been cased and the plurality of transverse fractures 116 have been formed, the transverse fracture farthest from the existing well 100 is sealed. The sealant is installed into the transverse fracture farthest from the existing well 100 by squeezing it into the transverse fracture. This is accomplished by first isolating the perforations adjacent to the fracture using a packer 135 (such as a hydraulically set drillable, retrievable or inflatable packer) on the end of tubing and set in the casing; then pumping the sealant in a fluid state through the tubing, then through the perforations and into the transverse fracture to be sealed until a sufficient volume of sealant has been placed into the transverse fracture to accomplish the barrier to flow by the invading waterflood.

The sealant can be a cement, a linear polymer mixture, a linear polymer mixture with cross-linker, an in-situ polymerized monomer mixture, a resin-based fluid, an epoxy based fluid, or a magnesium based slurry. All of these sealants are capable of being placed in a fluid state with the property of becoming a viscous fluid or solid barrier to fluid migration after or during placement into the fracture. In one embodiment, the sealant is $H_2$Zero™. Other sealants could include particles, drilling mud, cuttings, and slag. Exemplary particles could be ground cuttings so that a wide range of particle sizes would exist producing low permeability as compared to the surrounding reservoir.

Figure 2:
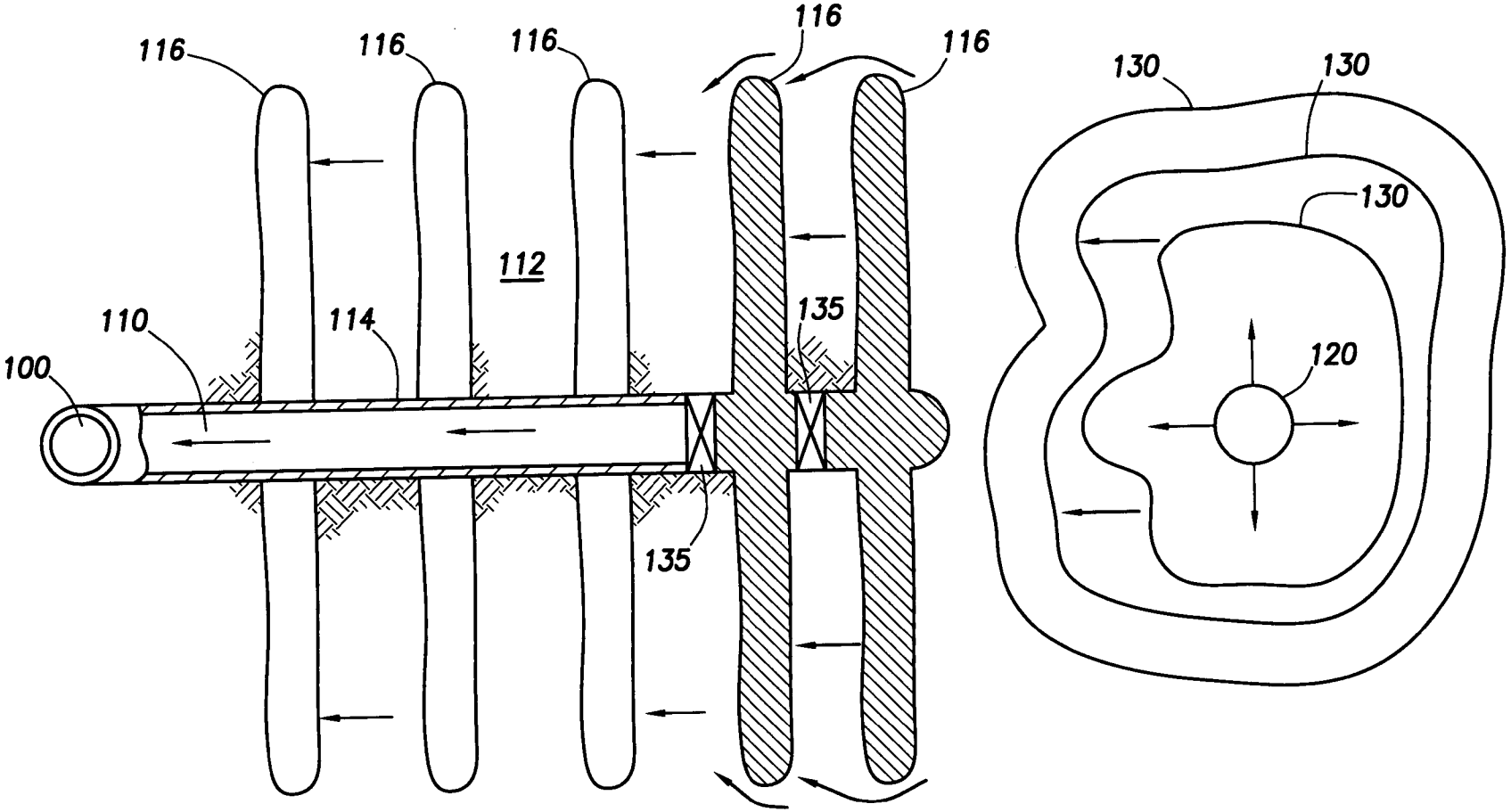
FIG. 2 is the embodiment illustrated in FIG. 1 wherein a second transverse fracture has been at least partially sealed to slow the progression of the fluid front.

An injection well 120 is then drilled remote from, but generally parallel to, existing well 100. In one certain embodiment, injection well 120 is drilled proximate the sealed transverse fracture 116. As those of ordinary skill in the art will appreciate, the injection well 120 can alternatively be formed prior to the formation of the substantially horizontal wellbore 110. Once the injection well 120 has been formed and the transverse fracture farthest from the existing well 100 sealed, flood fluid can be pumped down the injection well 120. As the flood fluid is pumped into the reservoir 112 it forms a propagating flood front 130. The flood front 130 is diverted around the sealed transverse fracture, as indicated in FIG. 1 by the large arrows. At the same time, hydrocarbons are drained into the transverse fractures 116, as indicated in FIG. 1 by the small arrows. As the adjacent transverse fracture begins producing high rates of flood fluid, it is sealed and a bridge plug 135 is installed in the substantially horizontal wellbore 110 just uphole of the adjacent transverse fracture, as illustrated in FIG. 2. Bridge plug 135 may be a mechanical bridge plug that is either drillable or retrievable. Alternatively, a plug made of particulate matter, e.g., sand or diverting agent can be used. In yet another embodiment, the plug 135 is formed of a removable viscous fluid. This isolation process is repeated as sufficiently high flood fluid ratios are being produced from successive transverse fractures until all of the transverse fractures have been sealed.

In one exemplary variant of the method illustrated in FIG. 1, the transverse fracture is only partially sealed in the near wellbore area rather than completely sealed all the way to its tip. The benefit of sealing the near wellbore area is that if the injection fluid happens to move faster in this area the flow of injection fluid can be partially diverted to improve sweep.

In another exemplary embodiment, a new transverse fracture is created during the sealing process in the near wellbore area. One method of pumping the sealing material is to use the SurgiFrac® fracturing service available from the assignee herein. If this process is used, then a fracture can be created and sealed in one step without the need of mechanical isolation.

In yet another variant of the method illustrated in FIG. 1, the transverse fracture nearest the toe 140 of the substantially horizontal wellbore is not sealed initially. Rather, it initially produces hydrocarbons. However, because the depletion of pressure resulting from hydrocarbon production in the substantially horizontal wellbore 110 encourages the flood front 130 to move in the direction of the horizontal wellbore 110, eventually the flood front 130 reaches the toe 140. When sufficiently high flood fluid ratios are being produced, a drillable packer is positioned between the transverse fracture nearest the toe 140 and the transverse fracture adjacent thereto. This isolates the transverse fracture nearest the toe from producing into the substantially horizontal wellbore 110 and the highly conductive fracture allows the flooding fluid to be distributed along the fracture. As the adjacent fracture begins producing high rates of flood fluid, this isolation process is repeated.

Another alternative method to setting packers includes installing a plug made of cement or other material that sets. The plug in the wellbore thus may be the same chemical or material used to seal the transverse fractures.

In one certain embodiment, a device 150 for monitoring the amount of infiltration of the flood fluid into the hydrocarbons being produced in the substantially horizontal wellbore 110 is installed adjacent to one or more of the fractures that have not been sealed. Examples of such devices include, but are not limited to, fluid flow meters, electric resistivity devices, oxygen decay monitoring devices, fluid density monitoring devices, pressure gauge devices, and temperature monitoring devices. Data from these devices can be obtained through electric lines, fiber-optic cables, retrieval of bottom hole sensors or other methods common in the industry. Another solution involves installing a sampling line into the production flow path. This could be a tubing (coiled or jointed) that takes a sample of the fluid at a point in the wellbore. If the sampling line is continuous tubing, then the well can be continuously monitored. In yet another embodiment, a sampling chamber is formed in the production flow path so that discrete samples of fluid can be taken. With such devices/solutions, the percentage of injection fluid to hydrocarbons can be measured at the surface, so that a judgment can be made whether to close a transverse fracture.

Figure 3:
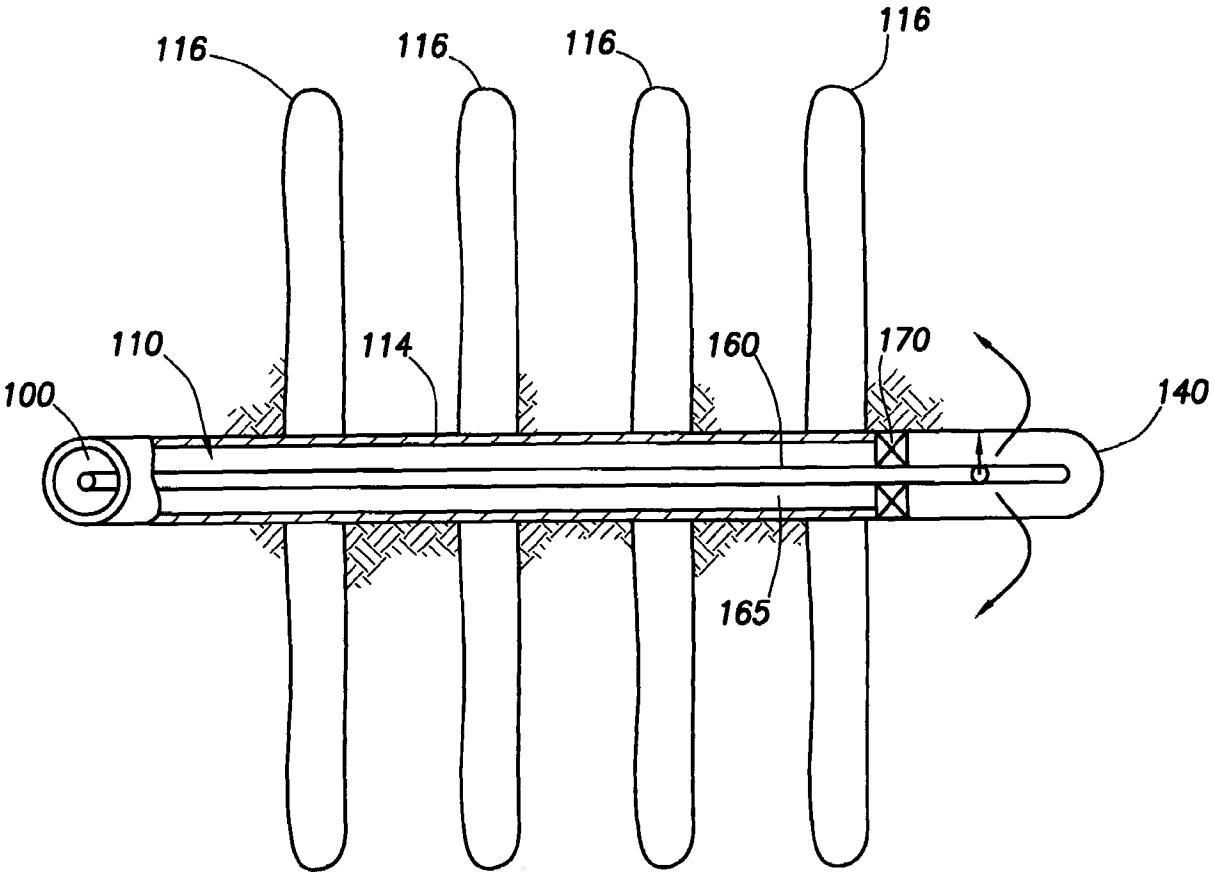
FIG. 3 is a schematic diagram illustrating another embodiment of the present invention wherein a tubing is used to inject a flood fluid into the reservoir.
Figure 4:
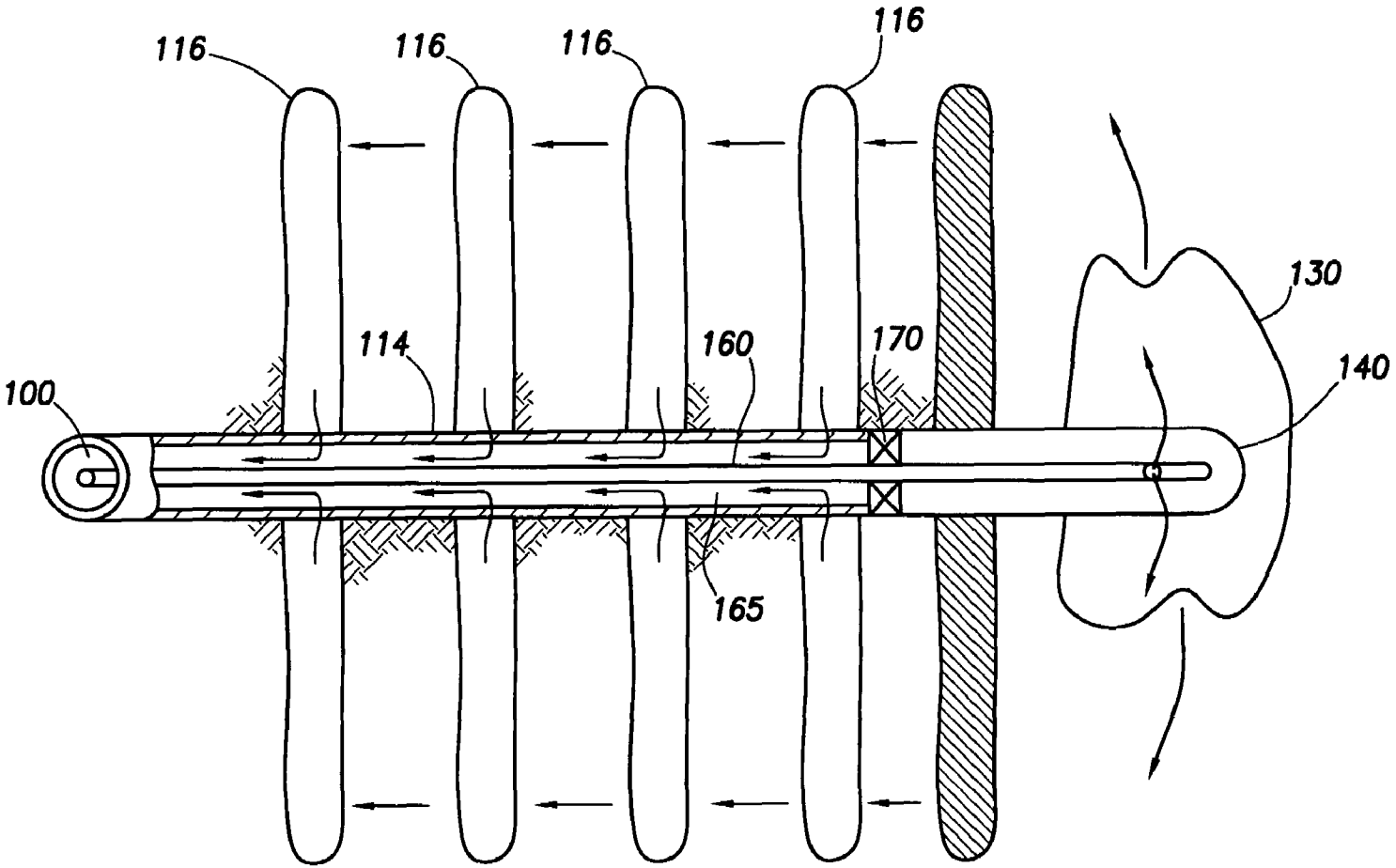
FIG. 4 is a modification of the embodiment illustrated in FIG. 1 wherein one of the transverse fractures is sealed and the tubing injects a flood fluid into the formation to sweep the hydrocarbons into the remaining transverse fractures.

Turning to FIG. 3, another embodiment of the method for increasing hydrocarbon production in accordance with the present invention is disclosed. In this embodiment, the flood fluid is introduced into the reservoir 112 through a tubing 160, which is installed into the substantially horizontal wellbore 110 rather than a separate injection well. The tubing 160 injects the flood fluid into the reservoir 112 from the toe 140 of the substantially horizontal wellbore 110. Hydrocarbons are produced up the annulus 165 formed between the tubing 160 and the casing 114. Packer 170 seals the end of the tubing 160, so the flood fluid does not enter into the annulus 165. Once the flood fluid ratio reaches a sufficiently high value, the transverse fracture nearest the toe 140 is sealed using the techniques described above. This process is repeated for successive transverse fractures 116 as the flood front 130 moves toward the existing well 100 and the flood fluid ratio begins to increase beyond an acceptable level. In a variant of this embodiment, the transverse fracture 116 closest to the toe 140 is sealed before the flood fluid is injected into the reservoir 112, as shown in FIG. 4.

Figure 5:
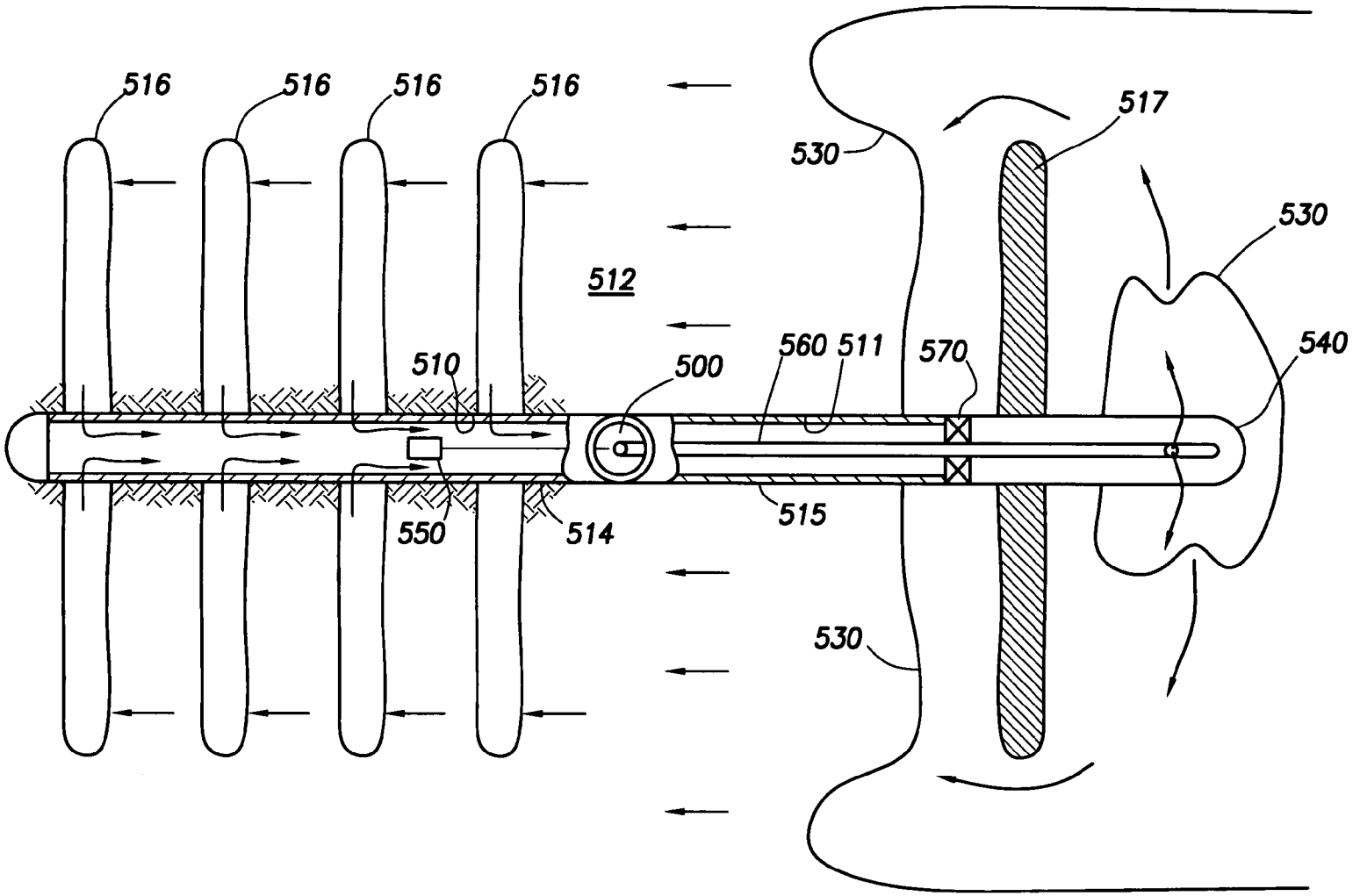
FIG. 5 is another embodiment of the present invention wherein two opposing substantially horizontal wellbores are drilled one of which acts as an injection well the other of which removes the hydrocarbons through a plurality of transverse fractures.

Turning to FIG. 5, yet another embodiment of the method in accordance with the present invention is illustrated. In this embodiment, two opposing substantially horizontal wellbores 510 and 511 are drilled into hydrocarbon reservoir 512 using conventional directional drilling techniques. Substantially horizontal wellbore 510 is cased with casing string 514 using conventional casing techniques. Substantially horizontal wellbore 510 is also formed with a plurality of generally parallel transverse fractures 516 using any one of the techniques described above. Substantially horizontal wellbore 511 may or may not be cased with casing string 515 depending upon the condition of the reservoir. At least one transverse fracture 517 is formed at the toe section 540 of substantially horizontal wellbore 511. This is accomplished by first isolating the perforations adjacent to the fracture using packer 570 on the end of the tubing 560 and setting it in the casing. Then, the sealant is pumped in a fluid state through the tubing 560, then through the perforations and into the fracture to be sealed until a sufficient volume of sealant has been placed into the fracture to accomplish the barrier to flow by the invading waterflood.

Fluid is injected into the reservoir 512 through toe section 540 of substantially horizontal wellbore 511 through the end of tubing 560. Flood front 530 propagates outward in the direction indicated by the arrows in FIG. 5. The sealed transverse fracture 517 helps to direct the fluid front in a manner which promotes drainage of the hydrocarbons into transverse fracture 516. As the flood fluid ratio reaches an unacceptably high level transfer fractures 517 are successfully sealed starting with transverse fracture closest to existing well 500 and moving downhole toward transverse fracture 516 closest to the toe portion of substantially horizontal wellbore 510.

A device for monitoring the amount of non-hydrocarbon fluid in the hydrocarbon production 550 may also be employed in substantially horizontal wellbore 510. The hydrocarbon production flows in the direction of the arrows moving up the annulus and wellbore 510 into existing wellbore 500.

Figure 6:
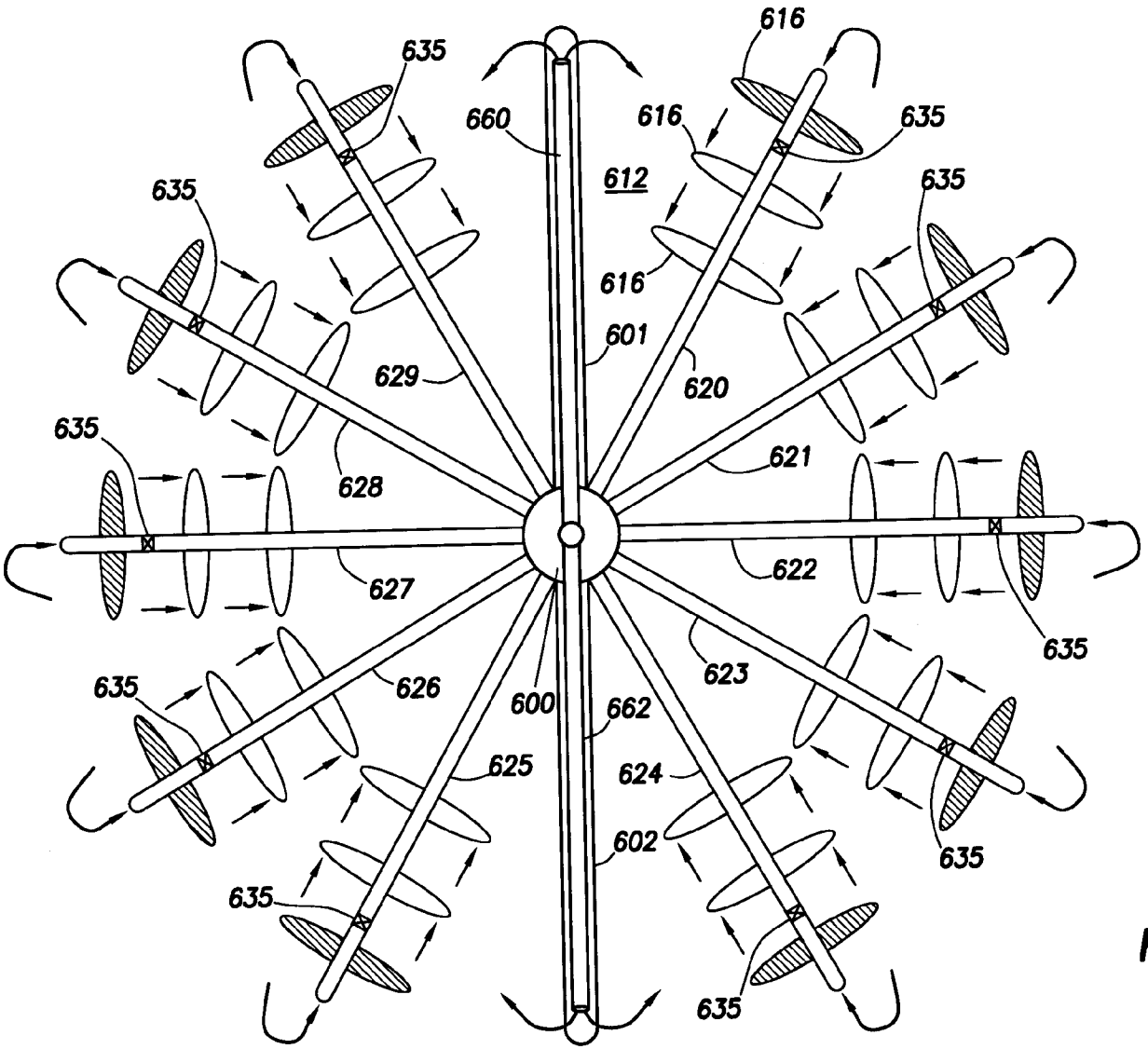
FIG. 6 is yet another embodiment of the present invention wherein a pair of opposed substantially horizontal injection wells inject fluid into the formation so as to sweep hydrocarbons into a plurality of substantially horizontal producing wellbores formed with a plurality of transverse fractures with the sweep direction of the hydrocarbon flow being toward the existing well.

Turning to FIG. 6, another embodiment of the method in accordance with the present invention is illustrated. In this embodiment a pair of opposing horizontal wellbores 601 and 602 formed using known techniques. Once formed, wellbores 601 and 602 can be used to inject a flood fluid into reservoir 612. In this embodiment a plurality of substantially horizontal wellbores 620 through 629 are disposed between opposed substantially horizontal injection wellbores 601 and 602. Each of the substantially horizontal production wellbores 620 through 629 has a plurality of transverse fractures 616 formed using any of the techniques described above. Each of the substantially horizontal production wellbores 620 through 629 may be cased with the casing 614. As those of ordinary skill in the art will appreciate, the exact number of wellbores in the pattern can vary depending upon the conditions of the reservoir.

In one embodiment, the transverse fractures farthest downhole from existing well 600 are all sealed and plugged with drillable plugs 635. The opposing substantially horizontal injection wells 601 and 602 may or may not be cased depending upon the nature of the reservoir 612. Those of ordinary skill in the art will appreciate those circumstances under which wellbore 601 and 602 should be cased. Tubing 660 and 662 are inserted respectively into wellbore 601 and 602. Flood fluid is injected into reservoir 612 through the ends of tubing 660 and 662 and the toe sections of wellbore 601 and 602. In this embodiment, the flood front sweeps inward toward the existing well 600. As the fluid flood ratio increases with the hydrocarbon production, over time successive transverse fractures uphole from the sealed fractures at the toes of horizontal wells 620 through 629 can be sealed to reduce the production of flood fluids. This process can be repeated until all of the transverse fractures have been sealed. In the embodiment of FIG. 6, flood fluid is introduced via tubing and produced up annuluses formed in the horizontal production wells 620 through 629.

Figure 7:
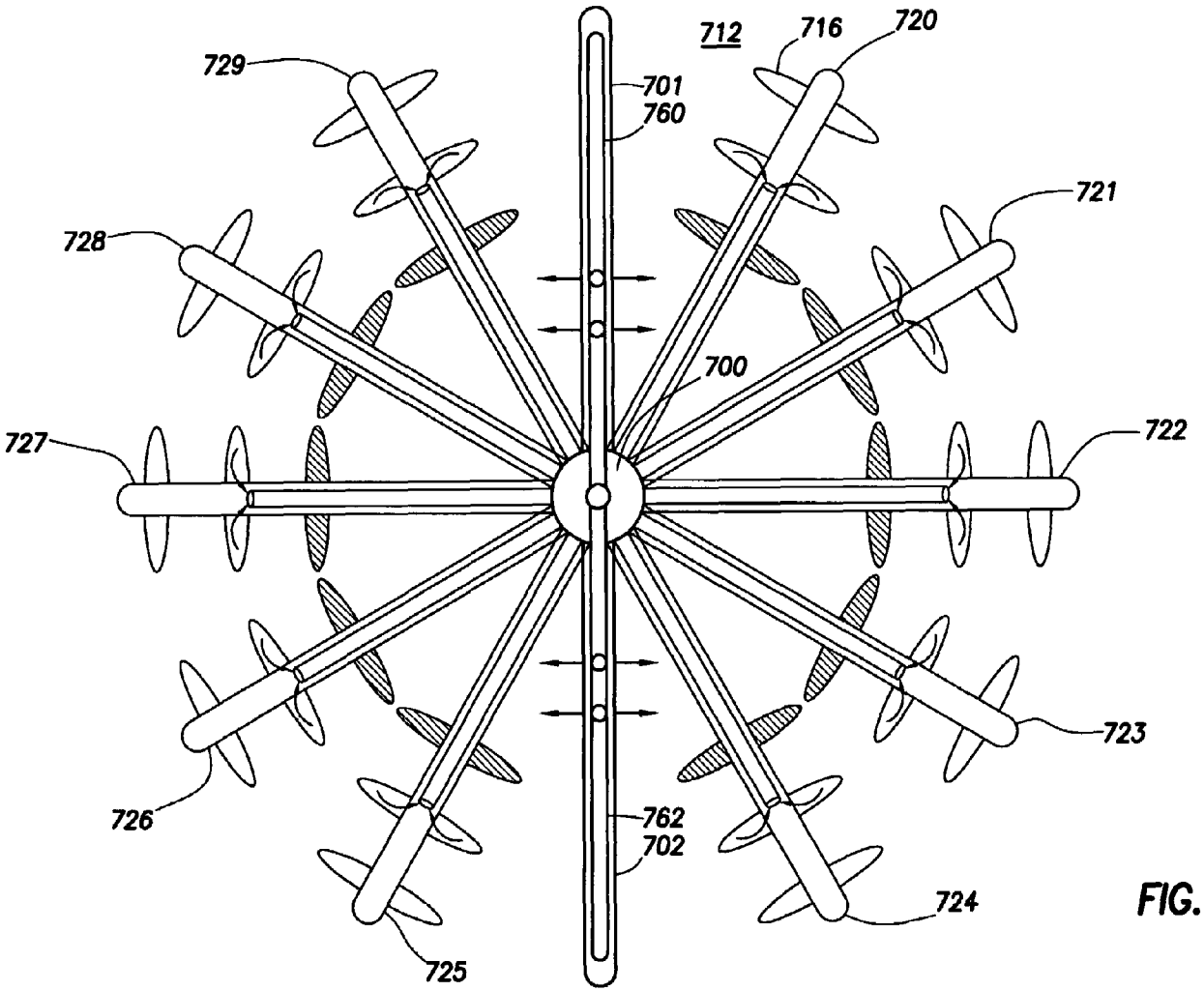
FIG. 7 is yet another embodiment of the present invention wherein a pair of opposed substantially horizontal injection wells inject fluid into the formation so as to sweep hydrocarbons into a plurality of substantially horizontal producing wellbores formed with a plurality of transverse fractures with the sweep direction of the hydrocarbon flow being away from the existing well.

Turning to FIG. 7 a variant of the embodiment of the method according to the present invention illustrated in FIG. 6 is shown. In this embodiment, the sweep of the flood front is from the existing well outward, i.e., it is an outward sweep. In this embodiment opposing substantially horizontal injection wells 701 and 702 are drilled using conventional directional drilling techniques. Substantially horizontal production wellbores 720 through 729 are formed with plurality of transverse fractures 716 using any one of the techniques described above. Each of the wellbores may or may not be cased depending upon the condition of the reservoir 712. As those of ordinary skill in the art will appreciate, the exact number of wellbores in the pattern can vary depending upon the conditions of the reservoir.

Front fluid is injected into the reservoir 712 through a plurality of injection ports formed along tubing 760 and 762 disposed in opposing substantially horizontal injection wellbore 701 and 702, respectively. In this embodiment the fluid front moves away from existing well 700. Accordingly, the transverse fractures closest to existing well 700 are the first to be sealed. Hydrocarbons are swept into the remaining transverse fractures and recovered up the existing well through annuli formed in each of the substantially horizontal production wellbores 720 through 729. As the flood front propagates outward and the ratio of flood fluid and the hydrocarbon production increases beyond an acceptable level additional transverse fractures are sealed successively outward until all of the transverse fractures in the substantially horizontal production wellbores 720 through 729 are sealed. As with all the other embodiments, a flood fluid monitoring device may be disposed in each of the substantially horizontal production wellbores 720 through 729.

Figure 8:
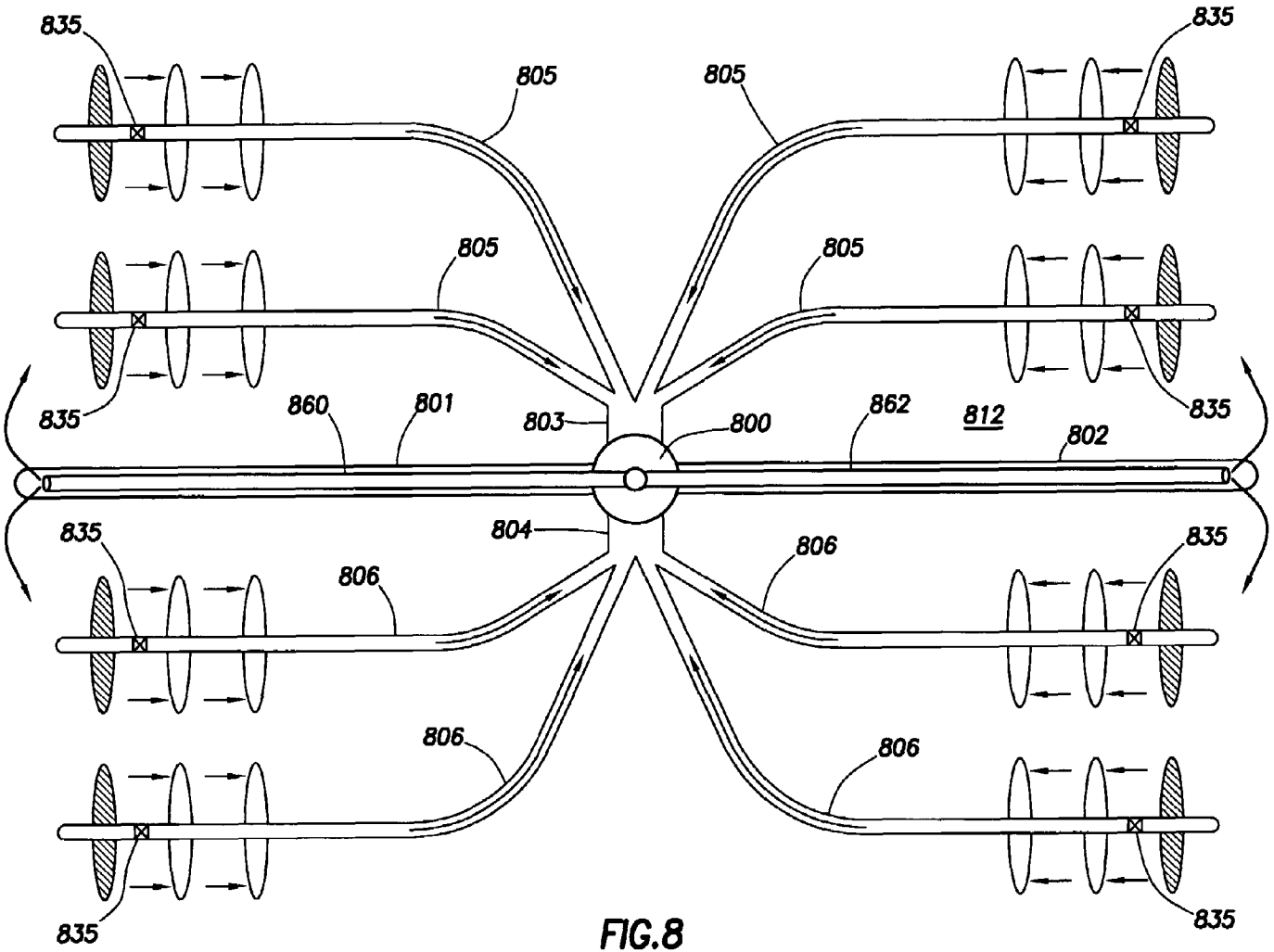
FIG. 8 is yet another embodiment of the present invention wherein a pair of opposed substantially horizontal injection wells inject fluid into the formation so as to sweep hydrocarbons into a pair of opposed substantially horizontal wellbores having a plurality of laterals formed with a plurality of transverse fractures with the sweep direction of the hydrocarbon flow being toward the existing well.

Turning to FIG. 8, yet another embodiment of the method of increasing hydrocarbon production in accordance with the present invention is illustrated. In this embodiment a pair of opposing substantially horizontal injection wellbores 801 and 802 are formed from existing well 800 in reservoir 812. Furthermore, a pair of opposing substantially horizontal production wellbores 803 and 804 are formed from existing wellbore 800. Substantially horizontal production wellbore 803 has a plurality of laterals 805 formed therefrom. Substantially horizontal production wellbore 804 similarly has a plurality of horizontal laterals 806 formed thereof. Each of the plurality of laterals 805 and 806 has a plurality of transverse fractures formed along their length using any one of the techniques described above. The horizontal wellbores 801, 802, 803 and 804 may or may not be cased with casing depending upon the conditions of the reservoir 812. As those of ordinary skill in the art will recognize the circumstances under which the horizontal wellbores 801 through 804 should be cased and whether or not to case laterals 805 and 806. The transverse fractures closest to the toes of each of the plurality of laterals 805 and 806 are sealed using the technique described above and plugged with drillable plugs 835 using the techniques described above. Opposing tubing 860 and 862 are disposed in injection wells 801 and 802, respectively. Front fluid is injected into reservoir 812 through ends of tubing 860 and 862, which are disposed in the toe sections of horizontal injection wells 801 and 802, respectively. Under this arrangement, the fluid front 830 sweeps inward. Successive transverse fractures are sealed and plugged as the front fluid ratio being produced increases beyond an acceptable level using the techniques described above. This process is repeated until all of the transverse fractures have been sealed.

Figure 9A:
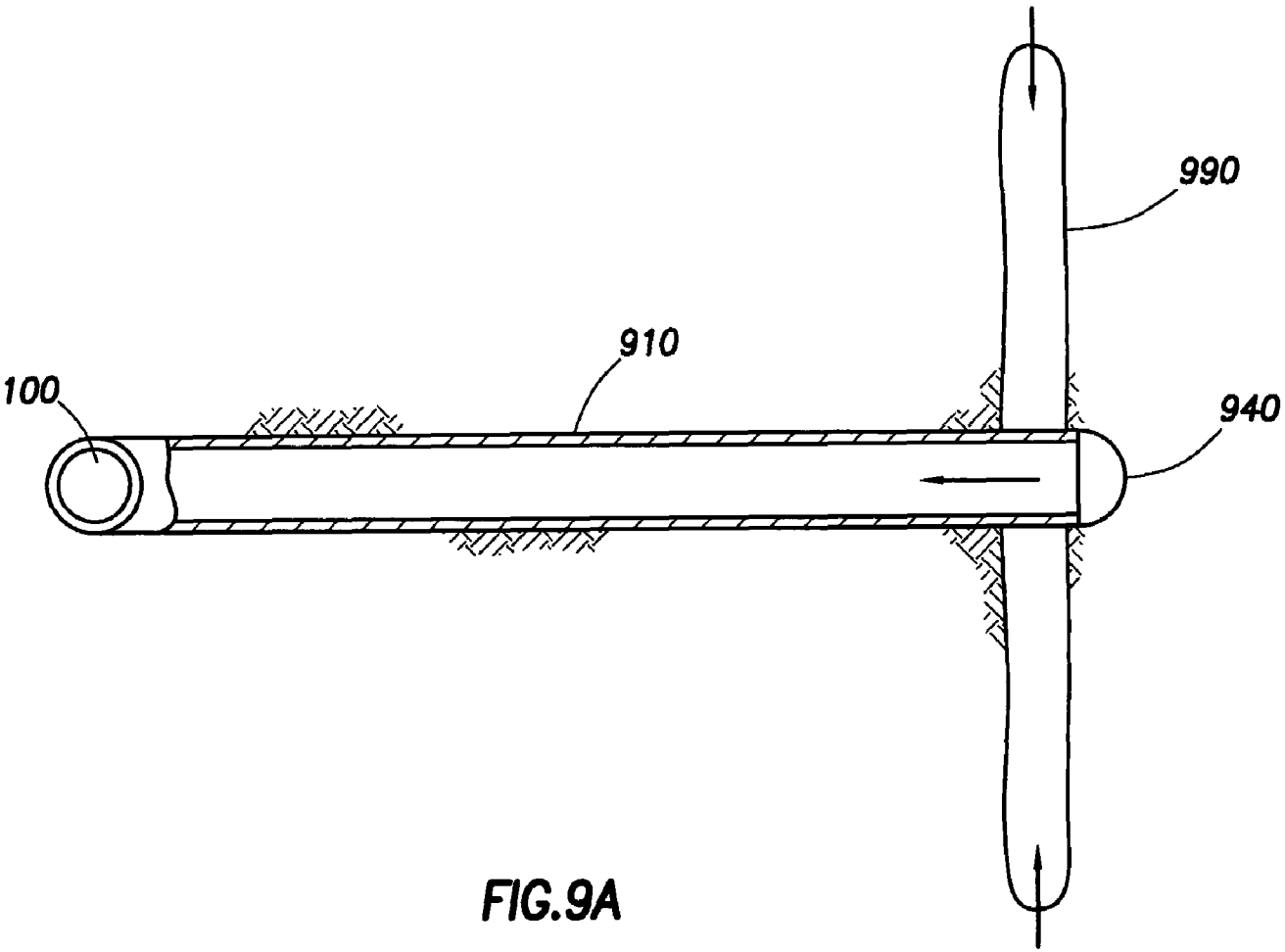
FIGS. 9A and 9B illustrate yet another embodiment of the present invention wherein a fracture is created in the toe of a horizontal lateral through which hydrocarbons are initially produced, and wherein subsequent transverse fractures are created progressively closer to the existing well and previously formed transverse fractures are sealed as unacceptable levels of non-hydrocarbons are produced.
Figure 9B:
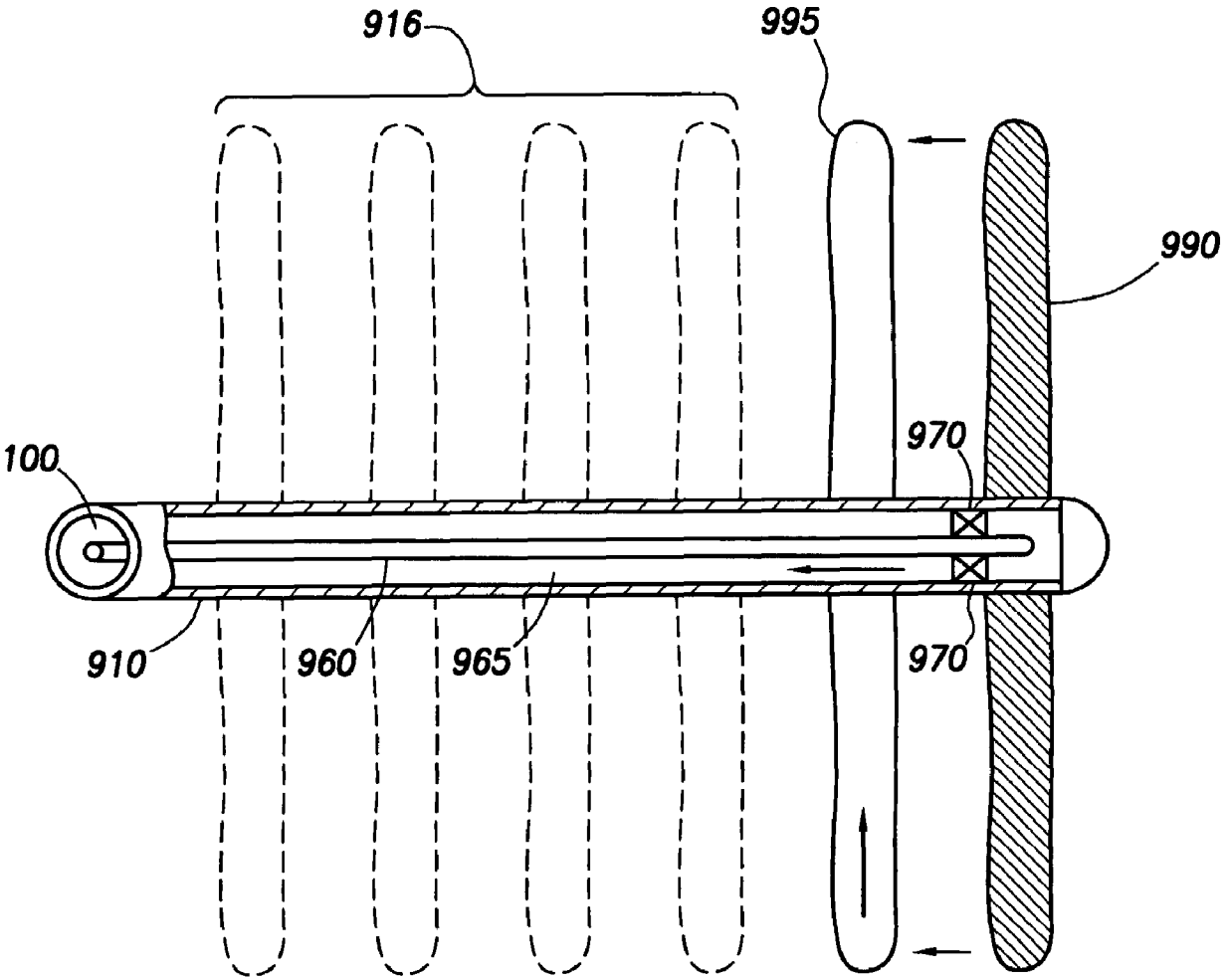

In yet another embodiment, transverse fractures 916 (shown in FIG. 9B) are created sequentially during the life of the well from one end to the other, so as to deplete the zone from one end to the other (such as toe-to-heel). In one example of this alternate method, a single transverse fracture 990 is created in the toe 940 of substantially horizontal wellbore 910, as shown in FIG. 9A. The well 910 would then be produced until the fracture produces an unacceptable level of injection fluid. Once this occurs, the transverse fracture 990 is sealed, and a second transverse fracture 995 is created uphole and subsequently produced until it reaches an unacceptable level of injection fluid at which point a third transverse fracture (not shown) is created and so on, as shown in FIG. 9B. This embodiment is advantageous if natural fractures of high permeability streaks exist in the reservoir because the injection fluid would not be able to move through the streak and enter multiple transverse fractures at one time.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. For example, as those of ordinary skill in the art will appreciate, the exact number, size and order of the transverse fractures formed is not critical. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of increasing the hydrocarbon production of an existing well in a hydrocarbon reservoir, comprising the steps of:

(a) drilling a substantially horizontal well bore that intersects the existing well;

(b) forming at least one transverse fracture in the reservoir along the substantially horizontal well bore;

(c) drilling an injection well into the reservoir;

(d) injecting a fluid into the reservoir through the injection well so as to force the hydrocarbons toward the at least one transverse fracture; and (e) draining the hydrocarbons into the at least one transverse fracture.

2. The method of increasing hydrocarbon production according to claim 1, wherein a plurality of transverse fractures are formed in the reservoir along the substantially horizontal well bore.

3. The method of increasing hydrocarbon production according to claim 2, further comprising a step (f) of installing a bridge plug in the substantially horizontal well bore between a transverse fracture farthest from the existing well and a transverse fracture adjacent to the farthest transverse fracture to seal off the farthest transverse fracture from the existing well when an unacceptable predetermined amount of non-hydrocarbon fluids begin seeping into the hydrocarbon production.

4. The method of increasing hydrocarbon production according to claim 3, further comprising the step of repeating step (f) for each transverse fracture that begins to allow the unacceptable predetermined amount of non-hydrocarbon fluids to seep into the hydrocarbon production.

5. The method of increasing hydrocarbon production according to claim 3, further comprising the step of squeezing a sealant into the farthest transverse fracture so as to divert the non-hydrocarbon fluids away from the remaining transverse fractures.

6. The method of increasing hydrocarbon production according to claim 5, wherein the sealant is pumped into the transverse fracture via a hydra jetting tool.

7. The method of claim 4, wherein the transverse fracture is formed at the same time that the sealant is being pumped.

8. The method of increasing hydrocarbon production according to claim 5, wherein the sealant comprises a material selected from the group consisting of a cement, a linear polymer mixture, a linear polymer mixture with cross-linker, an in-situ polymerized monomer mixture, a resin based fluid, an epoxy-based fluid and a magnesium based slurry.

9. The method of increasing hydrocarbon production according to claim 8, wherein the sealant comprises $H_2$Zero.

10. The method of increasing hydrocarbon production according to claim 1, further comprising the step of lining the substantially horizontal well bore with a casing string.

11. The method of increasing hydrocarbon production according to claim 10, wherein the casing string is cemented to a sidewall of the substantially horizontal well bore.

12. The method of increasing hydrocarbon production according to claim 2, wherein the plurality of transverse fractures are formed using a hydra jetting tool.

13. The method of increasing hydrocarbon production according to claim 12, wherein the hydra jetting tool forms each fracture of the plurality of transverse fractures one at a time.

14. The method of increasing hydrocarbon production according to claim 13, wherein the hydra jetting tool forms each transverse fracture by (i) positioning the hydra jetting tool in the substantially horizontal well bore at the location where the transverse fracture is to be formed, (ii) perforating the reservoir at the location where the transverse fracture is to be formed, and (iii) injecting a fracture fluid into the perforation at sufficient pressure to form a transverse fracture along the perforation.

15. The method of increasing hydrocarbon production according to claim 2, wherein the plurality of transverse fractures are formed by staged fracturing.

16. The method of increasing hydrocarbon production according to claim 15, wherein the staged fracturing is performed by (i) detonating a charge in the substantially horizontal well bore at the location where a transverse fracture is to be formed so as to form a perforation in the reservoir at that location, (ii) pumping a fracture fluid into the perforation at sufficient pressure to propagate the transverse fracture, (iii) installing a plug in the substantially horizontal well bore up hole of the transverse fracture, (iv) repeating steps (i) through (iii) until the desired number of transverse fractures have been formed; and (v) removing the plugs following the completion of step (iv).

17. The method of increasing hydrocarbon production according to claim 16, wherein the plug is a mechanical bridge plug selected from the group consisting of a drillable bridge plug and a retrievable bridge plug.

18. The method of increasing hydrocarbon production according to claim 16, wherein the plug is particulate matter selected from the group consisting of sand and diverting agents.

19. The method of increasing hydrocarbon production according to claim 16, wherein the plug is a viscous fluid that can be removed.

20. The method of increasing hydrocarbon production according to claim 2, wherein the plurality of transverse fractures are formed using a limited entry perforation and fracture technique.

21. The method of increasing hydrocarbon production according to claim 20, wherein the limited entry perforation and fracture technique is performed by (i) lining the substantially horizontal well bore with a casing string having a plurality of sets of predrilled holes arranged along its length, and (ii) pumping a fracturing fluid though the plurality of sets of predrilled holes in the casing string at sufficient pressure to fracture the reservoir at the locations of the sets of predrilled holes.

22. The method of increasing hydrocarbon production according to claim 2, wherein the plurality of transverse fractures are formed by (i) installing a tool having a plurality of hydra jets formed along its length into the substantially horizontal well bore, and (ii) pumping fluid though the plurality of hydra jets simultaneously at one or more pressures sufficient to first perforate and then fracture the reservoir at the locations of the hydra jets.

23. The method of increasing hydrocarbon production according to claim 2, further comprising the step of installing a device for monitoring the amount of infiltration of the non-hydrocarbon fluid into the hydrocarbons being produced in the substantially horizontal well bore adjacent to one or more of the fractures that have not been sealed.

24. The method of increasing hydrocarbon production according to claim 23, wherein the device for monitoring the amount of infiltration of the non-hydrocarbon fluid comprises a sampling tube ran from the surface to the substantially horizontal well bore from which samples of the fluid can be taken.

25. The method of increasing hydrocarbon production according to claim 5, wherein each of the transverse fractures are generally parallel to one another and the method further comprises a step (g) of sealing the transverse fracture adjacent to the transverse fracture previously sealed when the amount of non-hydrocarbon fluid infiltrating the hydrocarbons being produced reaches a predetermined undesirable value.

26. The method of increasing hydrocarbon production according to claim 25, further comprising the step of continuing to repeat step (g) until all but the last fracture has been sealed.

27. A method of increasing hydrocarbon production of an existing well formed in a hydrocarbon reservoir, comprising the steps of forming a substantially horizontal transverse fractured well bore that intersects the existing well; and injecting a fluid remote from the existing well so as to form a fluid front that forces the hydrocarbons to drain into the horizontal transverse fractured well bore.

* * * * *